US007905292B2

(12) United States Patent
Beall et al.

(10) Patent No.: US 7,905,292 B2
(45) Date of Patent: Mar. 15, 2011

(54) PRESSURE EQUALIZATION DEVICE FOR DOWNHOLE TOOLS

(75) Inventors: Clifford H. Beall, Broken Arrow, OK (US); Darren E. Bane, Broken Arrow, OK (US); Michael J. May, Broken Arrow, OK (US); James T. Sloan, Broken Arrow, OK (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 12/366,752

(22) Filed: Feb. 6, 2009

(65) Prior Publication Data

US 2010/0200220 A1 Aug. 12, 2010

(51) Int. Cl.
*E21B 34/06* (2006.01)

(52) U.S. Cl. ..... 166/332.7; 166/324

(58) Field of Classification Search ..... 166/324, 166/332.3, 332.7, 334.2
See application file for complete search history.

(56) References Cited

U.S. PATENT DOCUMENTS

| | | | | | |
|---|---|---|---|---|---|
| 3,236,255 | A | * | 2/1966 | Sizer | 137/494 |
| 3,971,438 | A | | 7/1976 | Crowe | |
| 4,130,166 | A | | 12/1978 | Akkerman et al. | |
| 4,197,879 | A | | 4/1980 | Young | |
| 4,289,165 | A | * | 9/1981 | Fredd | 137/625.32 |
| 4,325,434 | A | | 4/1982 | Roberts | |
| 4,368,871 | A | | 1/1983 | Young | |
| 4,446,922 | A | | 5/1984 | Bowyer et al. | |
| 4,449,587 | A | | 5/1984 | Rodenberger et al. | |
| 4,469,180 | A | * | 9/1984 | Turner | 166/324 |
| 4,470,576 | A | | 9/1984 | Schertler | |
| 4,522,370 | A | | 6/1985 | Noack et al. | |
| 5,417,405 | A | | 5/1995 | Stephan et al. | |
| 5,484,022 | A | | 1/1996 | Coutts et al. | |
| 5,865,246 | A | | 2/1999 | Brown | |
| 6,109,352 | A | | 8/2000 | Edwards et al. | |
| 6,223,824 | B1 | | 5/2001 | Moyes | |
| 6,378,841 | B1 | | 4/2002 | Russell | |
| 6,695,286 | B1 | | 2/2004 | Florio et al. | |
| 6,708,946 | B1 | | 3/2004 | Edwards et al. | |
| 6,832,656 | B2 | * | 12/2004 | Fournier et al. | 166/373 |
| 7,303,020 | B2 | * | 12/2007 | Bishop et al. | 166/374 |
| 2001/0045285 | A1 | | 11/2001 | Russell | |

OTHER PUBLICATIONS

Ross, Colby M., et al., "Current Materials and Devices for Control of Fluid Loss", SPE 54323, Apr. 1999, 1-16.
Nowlin, JR., WD., et al., "Overview of Classes of Currents in the deep water region of the Gulf of Mexico", OTC 12991, Apr. 2001, 1-7.
Andrews, Thad, et al, "Bidirectional Downhole Barrier Valve for Lubricator Applications", SPE 125083, Oct. 2009, 1-7.

* cited by examiner

*Primary Examiner* — William P Neuder
(74) *Attorney, Agent, or Firm* — Steve Rosenblatt

(57) ABSTRACT

A pressure equalizing tool can be run into a downhole tool on wireline or coiled tubing preferably and temporarily secured before being actuated to separate two components in a downhole tool that are in a sealing relation but are configured to be temporarily movable so as to allow pressure equalization before the downhole component is actuated. Once pressure is equalized the equalizing tool is released, usually with an applied pick up force and the downhole tool being equalized as to differential pressure can be operated with the preexisting actuation parts that are on the downhole tool. In a preferred embodiment the downhole tool is a ball valve and the equalizing tool is temporarily secured to the ball valve housing to temporarily part the ball from the uphole seat to equalize an annular space around the ball with tubing pressure. The ball is allowed to go back to contact with the seat when the equalizing tool is released and removed from the tubing.

20 Claims, 3 Drawing Sheets

PRESSURE EQUALIZATION DEVICE FOR DOWNHOLE TOOLS

FIELD OF THE INVENTION

The field of the invention is downhole tools that are constructed in a manner that make it possible to trap high differential pressures on movable components, which makes the components hard to move with actuation equipment unless such pressure differentials are equalized. In that context various tool embodiments are used to equalize pressure to enable subsequent operation using the normal actuation components.

BACKGROUND OF THE INVENTION

Downhole tools are controlled from the surface or locally by control systems to move a component between two or more positions. The movable components are exposed to highly variable tubing pressures and can be constructed in ways where pockets that trap pressure at some pressure level can form with a resulting high differential pressure across a tool component that is high enough to prevent the normal actuation system from operating the tool into another position.

One example of such a tool is a barrier valve that uses a 90 degree rotating ball. In some designs the ball turns between opposes seats that can have a resilient seal in contact with the ball. The actuation system can be in part in an annular space that is in communication with the passage in the ball around its pivot axis. When the valve is open tubing pressure and the annular space equalize through the small passage around the ball pivot axis. The ball can be closed during a time when the tubing pressure is low. Thereafter with the ball in the closed position and the annular space around the ball and the passage in the ball isolated from tubing pressure, pressure can build on the ball under conditions where the differential across the ball from tubing to the annular space results in increased contact frictional force so that the mechanism that would rotate the ball under normal operation is not strong enough to turn the ball back to the open position. Merely adding pressure above the ball during these circumstances just increases the differential across the ball with respect to the annular space and aggravates the contact loading problem.

The present invention in its various embodiments addresses this problem by equalizing pressure into the annular space by separation of a ball from its uphole seal in a rotating ball environment for a downhole valve. Other applications where trapped low pressures create loading to the point where the tool will not move normally are envisioned.

Equalizing devices in downhole tool and more particularly flapper type safety valves are well known as shown in Fineberg U.S. Pat. No. 4,478,286 and which included a spring loaded plug in the flapper that is actuated by a flow tube. Other equalizing devices are shown in U.S. Pat. Nos. 7,204,313; 6,848,509; 3,799,204; 6,644,408; 6,296,061; 6,283,217; 6,079,497 and 5,752,569. These valves generally have an equalizing valve built into a flapper to be actuated by the advancing flow tube before the flow tube tries to move the flapper. Alternatively the valve can be built into the housing to equalize across a closed flapper as a result of initial flow tube movement that occurs before the flow tube engages the flapper.

While the objective of the present invention is equalization to enable operation when large pressure differentials are present, its execution of that objective is different from the above described equalizing mechanism. Rather, in one embodiment a tool is delivered to the downhole tool needing pressure equalization. The tool is anchored and actuated to separate two members that are in sealing contact using built in flexibility of these parts to move relatively to each other. There after the tool is released and removed. It can be delivered quickly by wireline with a jar actuated to operate the tool or in another embodiment it can be delivered on coiled tubing and respond to pressure applied through the coiled tubing to operate. It can be released with a pickup force on the coiled tubing. Other embodiments are envisioned. Those skilled in the art will more fully appreciate the various aspects of the present invention by reviewing the descriptions of the embodiments described below in conjunction with the associated drawings while recognizing that the full scope of the invention is found in the appended claims.

SUMMARY OF THE INVENTION

A pressure equalizing tool can be run into a downhole tool on wireline or coiled tubing preferably and temporarily secured before being actuated to separate two components in a downhole tool that are in a sealing relation but are configured to be temporarily movable so as to allow pressure equalization before the downhole component is actuated. Once pressure is equalized the equalizing tool is released, usually with an applied pick up force and the downhole tool being equalized as to differential pressure can be operated with the preexisting actuation parts that are on the downhole tool. In a preferred embodiment the downhole tool is a ball valve and the equalizing tool is temporarily secured to the ball valve housing to temporarily part the ball from the uphole seat to equalize an annular space around the ball with tubing pressure. The ball is allowed to go back to contact with the seat when the equalizing tool is released and removed from the tubing.

DETAILED DESCRIPTION OF THE PREFERRED EMBODIMENT

Figure 1:
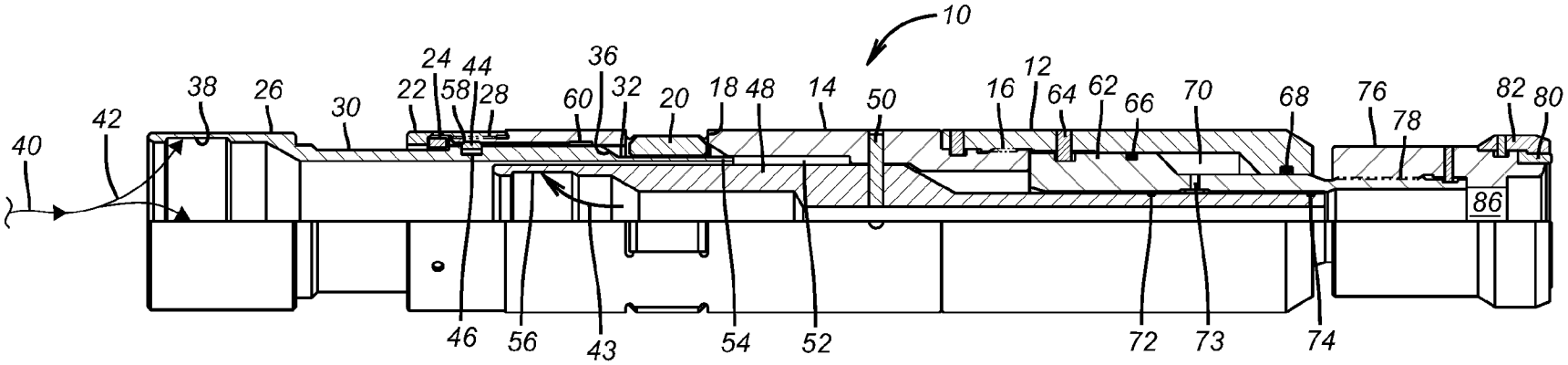
FIG. 1 is a section view of the equalizing tool in the run in position.
Figure 2:
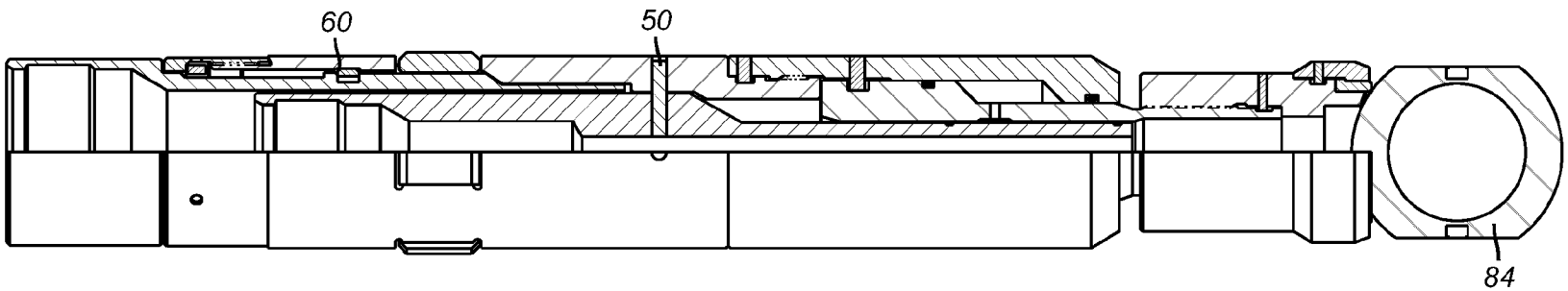
FIG. 2 is the tool of FIG. 1 in the anchored position and before pressure is equalized.

FIG. 1 shows the equalization tool 10. It has a lower body 12 and a dog housing 14 secured at thread 16. Dog housing 14 has openings 18 through which dogs 20 can be extended. A top sub 22 retains ring 24 internally so that actuator 26 can be fully extended to the position in FIG. 1 without coming out of the top sub 22. Top sub 22 is secured to the dog housing 14 at threads 28. Actuator 26 has a larger outer diameter 30 and a small outer diameter 32 separated by tapered surface 36. In the run in position of FIG. 1 the tool 10 has the actuator 26 fully extended so that the small outer diameter 32 is under the dogs 20 so that the dogs 20 are retracted into the openings 18. Actuator 26 has an internal groove 38. The tool 10 is run in on wireline 40 with a jar tool or other known tool that can create a jarring force on actuator 28 preferably at groove 38 with the jarring force shown schematically as arrows 42. Those skilled in the art will appreciate that in the FIG. 1 position a snap ring 44 is held in groove 46 by the dog housing 14. Inside the dog housing 14 is a release sleeve 48 that is shear pinned to dog housing 14 with a shear pin. A gap 52 is formed between the dog housing 14 and the release sleeve 48 to allow the lower end 54 of the actuator 26 to enter when the jar tool force 42 is applied. Internal recess 56 at the top of the release sleeve 48 can be grabbed by a fishing tool, not shown, for an emergency release of the dogs 20 as will be explained below. The jarring movement 42 puts the larger outer diameter 30 under the dogs 20 to cam them all out so that they can engage the tool to be equalized as will be discussed later in regard to FIG. 3. The only resistance offered by actuator 26 to moving down is any force required to make snap ring 44 jump out of a groove 58 that it sits in for run in and into another groove 60 where it snaps out with the dogs 20 in the extended position as shown in FIG. 2. The rating of shear pin 50 is considerably higher than the force required to drag the snap ring 44 from groove 58 to groove 60 and the friction force from it dragging on the inside surface of dog housing 14.

Figure 3:
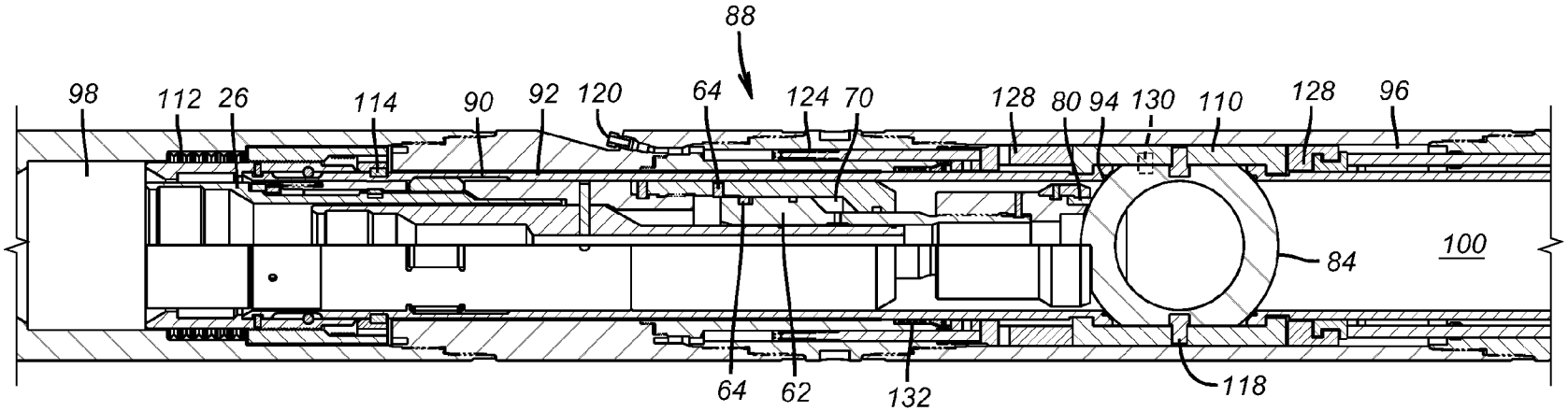
FIG. 3 shows the tool of FIG. 2 anchored in a ball valve in the closed position and the tool actuated to equalize pressure and the upper seat assembly.

Lower body 12 has a piston 62 that is initially secured with a shear pin 64. Seals 66 and 68 define atmospheric or low pressure chamber 70. Seals 72 and 74 seal the chamber 70 and the piston 62 initially to the release sleeve 48. A hard seat 76 is secured at thread 78 to the piston 62. A soft seat 80 is held by a retainer 82 to the hard seat 76. In a ball valve application as shown in FIG. 3, the soft seat 80 lands on the ball 84. The tool 10 has an open through passage 86 that gets obstructed when the soft seat 80 lands on the ball 84. Because of the passage 86 the tool 10 can be run in with wireline 40 at a high rate of speed. After the tool 10 is locked in position with dogs 20, surface pressure buildup acts on piston 62 to break the shear pin 64 to move the piston 62 against the low pressure chamber 70. This movement of the piston 62 moves the ball 84 to equalize pressure to annular space 96, as shown in FIG. 3. Passage 73 is exposed during emergency release when shear pin 50 is broken by an upward jar at fishing neck 56 of release sleeve 48 by a second jar tool schematically shown as 43 if the support for the dogs 20 by surface 30 cannot be undermined for removal of tool 10. Moving the release sleeve 48 opens chamber 70 to tubing pressure to equalize tubing pressure on piston 62.

Figure 4:
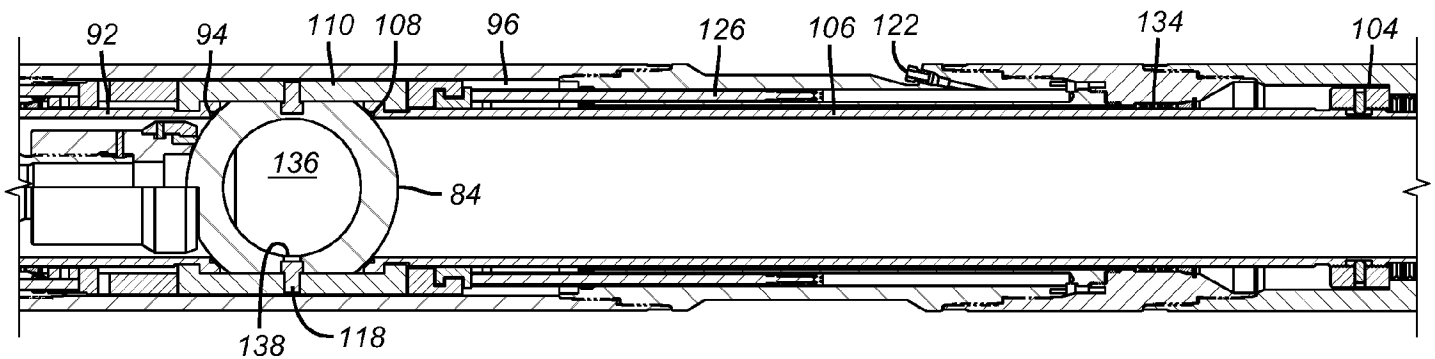
FIG. 4 shows the ball and lower seat assembly of the ball valve of FIG. 3.

FIG. 2 shows the tool 10 landed on the ball 84 with the actuator 26 pushed down so that the dogs 20 are extended by surface 30 to lock the tool 10 in position as can be seen by looking at FIG. 3, which is the top of the ball valve 88 while FIG. 4 is the bottom of valve 88. The tool 10 is shown in FIG. 3 after equalizing has taken place with shear pin 64 broken. FIG. 2 shows the dogs 20 extended before shear pin 64 is broken and FIG. 3 shows how the dogs 20 lock the tool 10 to the ball valve 88. As seen in FIG. 3, when the tool 10 lands on the ball 84 the dogs 20 are presented opposite groove 90 in upper seat assembly 92. Groove 90 is longer than dogs 20 so that after dogs 20 are extended and the pressure is built up, there is room for lower housing to move up to break shear pin 64 so that the applied pressure on piston 62 can ultimately move the ball 84 away from seal 94 for pressure equalization. When actuator 26 is pushed down the dogs 20 are extended and locked to the groove 90. Upper seat assembly 92 has a seal 94 that is against the ball 84. When there is pressure equalization the ball 84 is pushed by the tool 10 away from seal 94 to equalize an annular space 96 with tubing pressure at 98 above the ball 84. As the equalizing is done the pressure at 98 can be brought close to the pressure below ball 84 at 100 so that the ball 84 is equalized from above and below before it is to be rotated.

The workings of the valve 88 will now be briefly explained. Starting at the lower end there is an assembly that is preloaded by a spring 102 adjusted by changing the position of nut 104. Nut 104 pushes on lower seat assembly 106 which has a lower seal 108 pushed against the ball 84. An open cage 110 loosely secures the lower end of upper seat assembly 92 and its seal 94 to the ball 84 as well as securing the upper end of lower seat assembly 106 and its seal 108 to the ball 84. The upper ball seat assembly 92 is ultimately pushed toward the ball 84 by a spring 112 putting a force on ring 114 which is mounted to the upper ball seat assembly 92. The cage 110 supports ball 84 through opposed pins 116 and 118 for 90 degree rotation between an open position (not shown) and a closed position seen in FIGS. 3 and 4.

A control system is used to rotate the ball 84 through control line connections 120 shown in FIG. 3 and 122 shown in FIG. 4. Each connection has a piston 124 and 126 respectively. Pistons 124 and 126 are connected to opposite ends of a slide 128 that has a pin connection 130 shown in dashed lines in FIG. 3 to the ball 84 that is offset from its center pivots 116 and 118. Slide 128 slides through a recess (not shown) in the cage 110. Relative movement between the moving slide 128 and the stationary cage 110 rotates the ball. The direction of rotation is determined by which port 120 or 122 is pressurized and which has the pressure removed. The exterior of the upper seat assembly 92 is sealed to the housing of the valve 88 at seal 132. The lower seat assembly 106 is sealed to the housing of valve 88 at seal 134. The passage 136 through the ball 84 communicates with annular space 96 through a weep hole 138 near pivot 118. The annular space 96 extends from seal 132 to seal 134 and outside the ball 84 and the upper and lower seat assemblies 92 and 106.

What can happen is that the ball 84 can be in an open position when tubing pressure at 98 and 100 is fairly low such as 300 PSIG for example. Through weep hole 138 with the ball 84 open, the annular space 96 will equalize to that same 300 PSIG pressure. When the ball 84 is then closed the annular space 96 and the ball passage 136 are now isolated from tubing pressure above and below the ball due to seals 94 and 108 literally on the ball and seals 132 and 134 outside the upper and lower seat assemblies 92 and 106. The weep hole 138 just communicates the sealed off passage 136 inside the ball 84 to the annular space 96. The pressure can then go up either above the ball 84 at 98 or below the ball 84 at 100. The differential can rise to thousands of pounds to the point where the ball 84 can experience loading to the point where the pressure applied at the hydraulic connections 120 or 122 will not get the ball to turn or may result in shearing the drive pin 130 at the location that it extends from the ball 84. Simply adding pressure above the closed ball 84 just causes additional loading as the pressure differential across it is enhanced.

This frictional loading problem caused by high differential pressure across the ball 84 is resolved by the tool 10. As shown in FIG. 3 the tool 10 is anchored using dogs 20 in groove 90 in the upper ball seat 92. With soft seat 80 landed on the ball 84 and dogs 20 latched to groove 90 of upper ball seat assembly 92, applying pressure in the tubing at 98 breaks shear pin 64. Tubing pressure at 98 is present above piston 62 and low or atmospheric pressure is in chamber 70 allowing the piston 62 to move down forcefully and reduce the volume of chamber 70 while pushing down on ball 84 as the tool 10 is anchored at dogs 24. The pushing of the ball 84 by the soft seat 80 separates the ball 84 from the seal 94 to allow the annular space 96 to equalize with whatever pressure was applied above the ball 84 at 98. The gap is made possible by slack between the cage 110 and where it retains the upper and lower seat assemblies 92 and 106 respectively. In essence spring 102 is compressed and spring 112 is extended as a gap is created by the tool 10 between the seal 94 and the ball 84. If the pressure at 98 is selected close to that below the ball 84 at 100, the operation of the tool 10 essentially makes the pressure in the annular space 96 and inside the ball at 136 the same as in the tubing so that the hydraulic system can operate the ball 84 in the normal manner.

Figure 5:
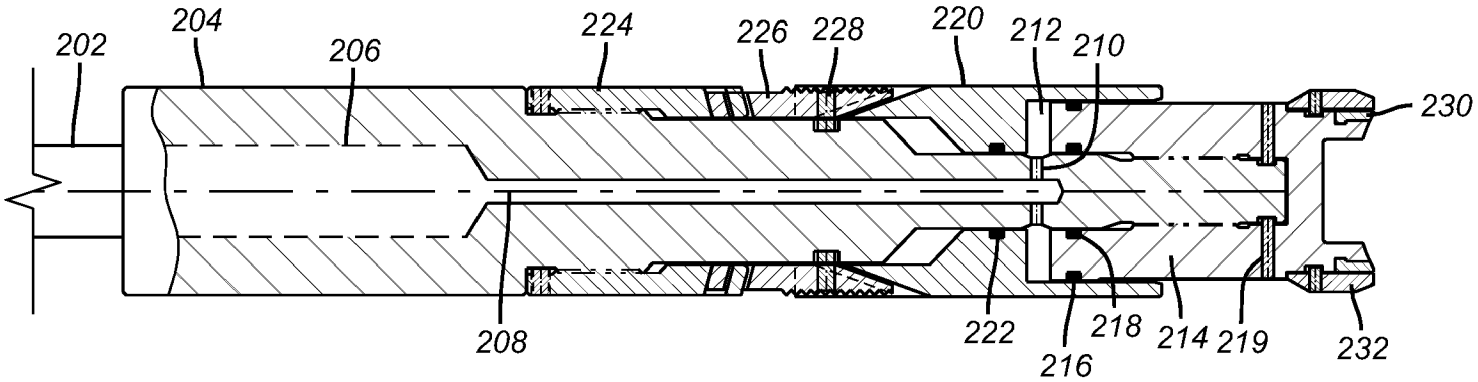
FIG. 5 is an alternative embodiment of the equalizing tool when run in on tubing.
Figure 6:
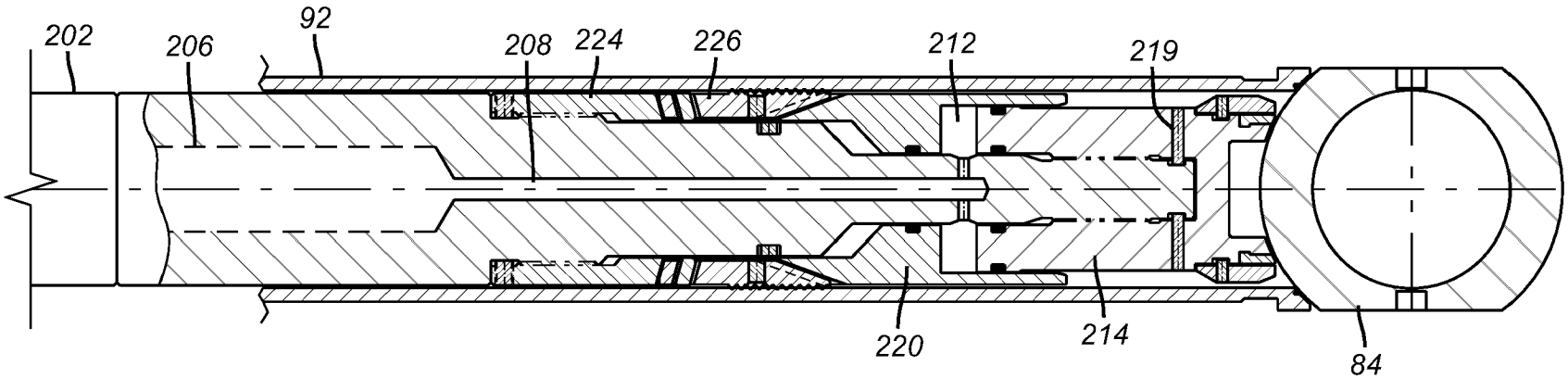
FIG. 6 is the tool of FIG. 5 shown anchored in a ball valve and pressure equalized.

Referring now FIGS. 5 and 6 a different embodiment of the equalizing tool 200 is illustrated. It is run preferably on coiled tubing 202 but it can be run on rigid tubing in the alternative although it would take far longer to get it into position into a downhole tool such as a ball valve 88 located on a tubing string. The tubing 202 is connected to mandrel 204 at thread 206. A passage 208 runs through the mandrel 204 to a port 210 that leads into an annular passage 212. Piston 214 has seals 216 and 218 to allow pressure delivered through the coiled tubing 202 to reach the piston 214 to drive it along of mandrel 204 after breaking shear pin 219. Also mounted to mandrel 204 is a cone 220 with a seal 222. A slip ring 224 is supported by the mandrel 204. It has a series of slips 226 that are initially retained to the mandrel 204 by a shear pin or pins 228. As in the other embodiment there is at the lower end of piston 214 a soft seat 230 to contact the ball 84 and a retainer 232 surrounding the soft seat 230 for support.

In operation, as shown in FIG. 6, the soft seat 230 is landed on the ball 84 and pressure is built up in passage 208 so that the cone 220 is driven under the slips 226 to drive them out, while breaking pin 228, against the upper seat assembly 92 that is shown in FIG. 3 with the other embodiment. At this time pin 219 is not yet broken but the tool 200 is now anchored. A further pressure buildup breaks the pin 219 and the piston 214 is extended to push the ball 84 from its seal 94 shown in FIG. 3 for pressure equalization. It should be noted that pressure outside the tool 200 is applied as pressure is equalized so that the annular space 96 will then be at a pressure close to the pressure downhole of the closed ball 84 to allow simple operation of the ball 84 without concern of breaking the actuation mechanism due to the frictional contact force from high pressure differential as the actuation systems attempts to rotate the ball 84 to the open position. Cone 220 can be biased to the retracted position by reducing pressure in annular space 212 to make the cone 220 and the piston 214 retract toward each other so that the tool 200 can be pulled out with the coiled tubing 202 because the slips 226 have become unsupported by the retraction of the cone 220.

Those skilled in the art will appreciate that the tools 10 or 200 allow for pressure equalization for components operated in a downhole tool from a remote location. There are no additional valves added to an assembly within the tool housing. Instead an equalizing tool is rapidly deployed to the downhole tool and simply physically separates a downhole component from an adjacent seal to equalize pressure between formerly isolated zones affecting the component so the actuation system operated from outside the downhole tool can move the component without damage to the actuation system or the component from component loading that otherwise occur when there are significant pressure differences across the component before it is urged to move. In some cases such a valve the component can be a ball. Other applications where an actuated component can be placed under a pressure imbalance that needs to be equalized before the component is moved are also envisioned.

The above description is illustrative of the preferred embodiment and many modifications may be made by those skilled in the art without departing from the invention whose scope is to be determined from the literal and equivalent scope of the claims below:

We claim:

1. A pressure equalizing tool assembly for subterranean use to equalize pressure on a component of another tool disposed in a wellbore, comprising:

a downhole tool having a housing with at least one end connection for placement at a subterranean location on a string connected to said end connection, said housing comprising a movable component in a passage, where movement of said component to a first position creates a closed chamber with respect to said passage that can be at a lower pressure than in said passage;

a pressure equalizing tool insertable through the string and into said passage of said housing when said housing is at the subterranean location and operable to create a gap adjacent said component to equalize pressure between said chamber and said passage by opening a flow path around a periphery of said component.

2. A pressure equalizing tool assembly for downhole use to equalize pressure on a component of another tool disposed in a wellbore, comprising:

a downhole tool having a housing with a movable component in a passage, where movement of said component to a first position creates a closed chamber with respect to said passage that can be at a lower pressure than in said passage;

a pressure equalizing tool insertable into said housing and operable to equalize pressure between said chamber and said passage;

said pressure equalizing tool creates a gap between said component and an adjacent seal.

3. A pressure equalizing tool assembly for downhole use to equalize pressure on a component of another tool disposed in a wellbore, comprising:

a downhole tool having a housing with a movable component in a passage, where movement of said component to a first position creates a closed chamber with respect to said passage that can be at a lower pressure than in said passage;

a pressure equalizing tool insertable into said housing and operable to create a gap adjacent said component to equalize pressure between said chamber and said passage;

said pressure equalizing tool further comprises an anchor selectively actuated to secure said pressure equalizing tool to said downhole tool.

4. The assembly of claim 3, wherein:

said anchor is set before said movable component is moved by said pressure equalizing tool.

5. The assembly of claim 3, wherein:

said anchor is actuated by a wireline supported jar tool.

6. The assembly of claim 3, wherein:

said anchor is actuated by pressure applied to coiled tubing that supports said pressure equalizing tool.

7. The assembly of claim 3, wherein:

said pressure equalizing tool further comprises a piston selectively actuated by applied pressure in said passage to move said movable member.

8. The assembly of claim 6, wherein:

said pressure equalizing tool further comprises a piston selectively actuated by applied pressure in said coiled tubing to move said movable member.

9. The assembly of claim 8, wherein:

said anchor and said piston are actuated with coiled tubing pressure;

said anchor further comprises a cone selectively driven under at least one slip from a common space that communicates coiled tubing pressure to said piston to move said cone and said piston sequentially in opposed directions.

10. The assembly of claim 7, wherein:

said downhole tool comprises a rotating ball that closes said passage in a first position and opens said passage in a second position and further comprises an upper and a lower seat assembly disposed on opposed sides of said ball;

said piston selectively creating a gap between said ball and said upper seat assembly.

11. The assembly of claim 10, wherein:

said piston lands on said ball when inserted in said passage and spaces said anchor in opposition of a retaining groove in said upper seat.

12. The assembly of claim 11, wherein:

said anchor comprises at least one dog actuated radially into said retaining groove by an actuating sleeve moved toward said ball.

13. The assembly of claim 12, wherein:

said piston comprises a circular soft seat that lands on said ball.

14. The assembly of claim 13, wherein:

said upper and lower seat assemblies are biased toward said ball and comprise pressure seals in contact with said ball and external seals to said passage;

said chamber defined outside said ball and between said external seals;

said chamber in communication with said passage when said ball is in said second position.

15. The assembly of claim 14, wherein:

said ball having a ball passage therethrough and aligned with said housing passage and in flow communication with said cavity when said ball is in said second position;

said ball passage and said cavity isolated from said housing passage when said ball is in said first position.

16. The assembly of claim 15, wherein:

said circular soft seat pushes said ball when said ball is in said first position to push said ball away from said pressure seal on said upper seat to equalize said cavity with said housing passage.

17. The assembly of claim 12, wherein:

said actuating sleeve is moved by a jar tool suspended from a wireline that delivers said pressure equalizing tool.

18. The assembly of claim 10, wherein:

said piston is releasably secured to said housing and defines a low pressure chamber that is reduced in volume when pressure applied to said housing releases the piston to move said ball.

19. The assembly of claim 18, wherein:

said pressure equalizing tool further comprises a release sleeve that selectively blocks a vent passage from said low pressure chamber, said piston exposed to balanced housing pressure when said release sleeve is shifted.

20. The assembly of claim 19, wherein:

said actuating sleeve is moved by a first jar tool suspended from a wireline that delivers said pressure equalizing tool;

said release sleeve is actuated by a second tool to equalize said piston by jarring said release sleeve in an opposite direction from the direction that said first jar tool jars said actuating sleeve.

* * * * *